US010697035B2

(12) United States Patent
Sohmshetty et al.

(10) Patent No.: US 10,697,035 B2
(45) Date of Patent: Jun. 30, 2020

(54) 3-D PRINTED COOLING CHANNELS TO PRODUCE PHS PARTS WITH TAILORED PROPERTIES

(71) Applicant: FORD MOTOR COMPANY, Dearborn, MI (US)

(72) Inventors: Raj Sohmshetty, Canton, MI (US); Varinder Singh Saini, Canton, MI (US); Constantin Chiriac, Windsor (CA)

(73) Assignee: FORD MOTOR COMPANY, Dearborn, MI (US)

( * ) Notice: Subject to any disclaimer, the term of this patent is extended or adjusted under 35 U.S.C. 154(b) by 181 days.

(21) Appl. No.: 15/723,350

(22) Filed: Oct. 3, 2017

(65) Prior Publication Data

US 2019/0100820 A1 Apr. 4, 2019

(51) Int. Cl.

| | |
|---|---|
| ***C21D 9/00*** | (2006.01) |
| ***C21D 1/673*** | (2006.01) |
| *C21D 8/00* | (2006.01) |
| *C21D 9/08* | (2006.01) |

(52) U.S. Cl.

CPC ..... *C21D 9/0062* (2013.01); *C21D 1/673* (2013.01); *C21D 8/005* (2013.01); *C21D 9/085* (2013.01); *C21D 2221/00* (2013.01)

(58) Field of Classification Search

CPC ..... C21D 9/0062; C21D 1/673

See application file for complete search history.

(56) References Cited

U.S. PATENT DOCUMENTS

| | | | | |
|---|---|---|---|---|
| 3,340,714 | A * | 9/1967 | Karl-Heinz Pohl | B29C 51/082 156/224 |
| 2016/0024608 | A1 | 1/2016 | Singh | |
| 2016/0059295 | A1* | 3/2016 | Frost | B21D 22/02 72/354.6 |
| 2016/0303637 | A1 | 10/2016 | Schleichert et al. | |

FOREIGN PATENT DOCUMENTS

| | | | |
|---|---|---|---|
| CN | 102319835 | A | 1/2012 |
| CN | 103409613 | B | 9/2014 |
| KR | 20110065068 | A | 6/2011 |

OTHER PUBLICATIONS http://www.3ders.org/articles/20161017-schuler-introduces-3d-printed-hot-stamping-dies-for-more-efficient-cooling.html, Mar. 10, 2017, pp. 1-8.

U.S. Appl. No. 15/467,607, filed Mar. 23, 2017, 16 pgs.

* cited by examiner

*Primary Examiner* — Scott R Kastler

(74) *Attorney, Agent, or Firm* — Vincent Mastrogiacomo; Brooks Kushman P.C.

(57) ABSTRACT

A hot stamping die includes a body having a stamping surface, and cooling channels within the body. The cooling channels are positioned to transfer heat from region(s) of the surface to the channels. The hot stamping die also includes a heating element within the body, separate and apart from the channels. The heating element is positioned to heat region(s) of the body different from the region(s) of the surface at a rate greater than heat transfer from the channels to the region(s) of the surface.

19 Claims, 3 Drawing Sheets

3-D PRINTED COOLING CHANNELS TO PRODUCE PHS PARTS WITH TAILORED PROPERTIES

TECHNICAL FIELD

This disclosure relates to forming vehicle components with tailored properties using conformal cooling and heating.

BACKGROUND

Hot stamping is a metal forming process that may include heating an article or component to be formed and then stamping the article while it is still at an elevated temperature. For example, when hot stamping a steel article, the article may be heated to a temperature at which the microstructure of the steel is converted to austenite (e.g., austenitizing). This temperature may be around 900-950° C., depending on the composition of the steel.

In some hot stamping processes, the dies of the stamping mold that provide the desired shape to the stamped article may be cooled. The cooled dies may cool the article as it is being stamped. If the cooling rate of the dies is sufficiently high, the microstructure of the stamped article may be converted to a high strength phase. In the case of steel components, a sufficient cooling rate may result in a martensitic microstructure. Hot stamping may also be used to form articles made from other metals, such as aluminum. For example, aluminum alloys may be solution heat treated and quenched using a hot stamping process.

The dies for the hot stamping process may be cooled by cooling channels formed in the dies using mechanical processes such as gun drilling. Gun drilled cooling channels may reduce the ability to control cooling rates in various areas of the die and may limit the heat transfer surface area available for cooling in the die. These limitations may reduce the ability to impart microstructure variations in the hot stamped article.

SUMMARY

According to an embodiment, a hot stamping die is disclosed. The hot stamping die includes a body having a stamping surface, and cooling channels within the body. The cooling channels are positioned to transfer heat from region(s) of the surface to the channels. The hot stamping die also includes a heating element within the body, separate and apart from the channels. The heating element is positioned to heat region(s) of the body different from the region(s) of the surface at a rate greater than heat transfer from the channels to the region(s) of the surface.

According to one or more embodiments, the hot stamping die may have a heat transfer rate from the heating element to the body region(s) may correspond to a cooling rate of less than about 27 K/s. The heat transfer rate from the channels to the surface region(s) may correspond to a cooling rate of greater than about 27 K/s. In some embodiments, the heating element may be a heating coil. In other embodiments, the heating element may be a heating channel configured to receive a heating fluid. In other embodiments, the heating element may be a cavity in the body below the body region(s) configured to reduce heat transfer from the body region(s) to the channels. The heating element may be separated from the channels by an insulation barrier within the body. In some embodiments, the insulation barrier may be a cavity.

According to an embodiment, a hot stamping die is disclosed. The hot stamping die includes a body having a stamping surface, and cooling channels within the body. The cooling channels are configured to remove heat from region(s) of the surface. The hot stamping die further includes a heating element within the body to heat region(s) of the body different from the surface region(s) at a rate greater than heat transfer from the channels to the surface region(s). The hot stamping die also includes an insulation barrier within the body configured to minimize heat exchange between the heating element and channels.

According to one or more embodiments, the insulation barrier may be a cavity in the body. In some embodiments, the heating element may be a heating coil. In other embodiments, the heating element may be a heating channel configured to receive a heating fluid. The heat transfer rate from the heating element to the body region(s) may correspond to a lower cooling rate than a heat transfer rate from the channels to the surface region(s). The heat transfer rate from the heating element to the body region(s) may correspond to less than about 27 K/s. The heat transfer rate from the channels to the surface region(s) may correspond to greater than about 27 K/s. The heating element may have a higher rate of heat transfer to the body region(s) than to the insulation barrier, and the channels may have a higher rate of heat absorption than absorption from the insulation barrier.

According to another embodiment, a method of stamping a vehicle part is disclosed. The method includes forming a die having a stamping surface using printed inserts configured to form cooling channels and a heating element within bulk material of the die. The channels and elements are configured to vary heat transfer at region(s) of the surface. The method further includes positioning a blank on the surface, and stamping the blank to produce variable strength zones based on heating and cooling of the surface region(s).

According to one or more embodiments, the heating and cooling of the surface region(s) may include flowing cooling fluid through the cooling channels. In other embodiments, heating and cooling of the surface region(s) may include circulating heating fluid in the heating elements or activating a heating coil. In some embodiments, the forming step may include positioning the printed inserts in a mold and molding a body of bulk material into a die.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

According to one or more embodiments, the present disclosure describes a hot stamping die with 3D-printed die inserts to control heating and cooling for forming a vehicle component with tailored properties. Gun drilled cooling channels may not only limit the cooling properties of the die, but also may not form efficient warm zones to produce press-hardened steel (PHS) parts with selected region(s) with varying strength. To produce PHS parts with both soft and hard zones, the conformal 3D-printed cooling channels are supplemented with heating element inserts to form warmer zones on the stamping surface, as compared to the cooled regions of the surface. Thus, vehicle parts with tailored properties, such as variable strength, can be formed by the stamping process.

Figure 1A:
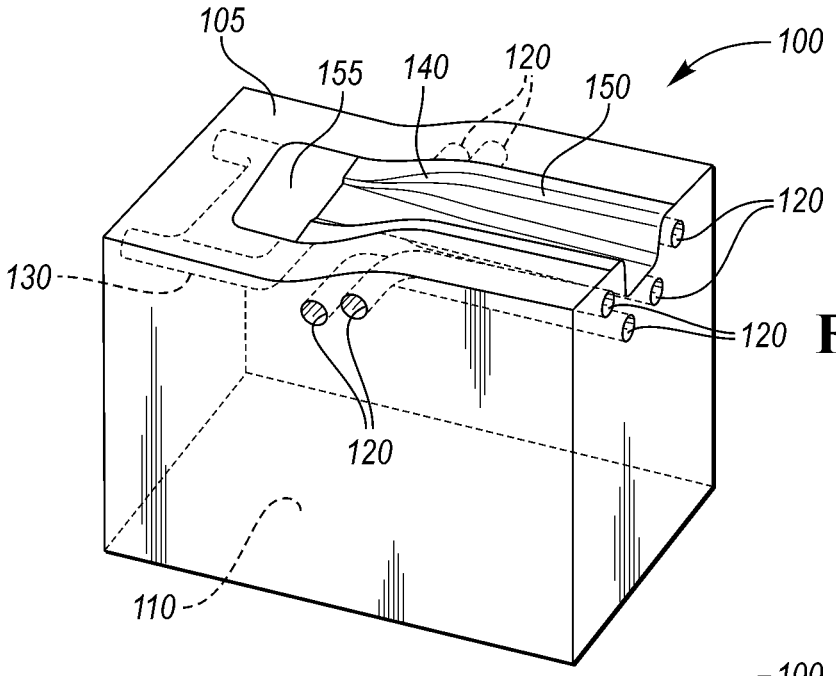
FIG. 1A shows a perspective view of a schematic diagram of a hot stamping die according to an embodiment.
Figure 1B:
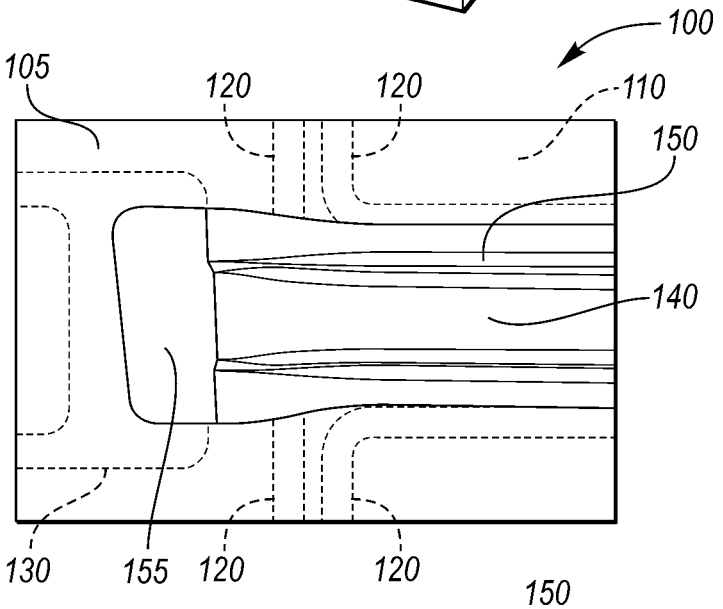
FIG. 1B shows a partial top view of the schematic diagram of the hot stamping die according to an embodiment.
Figure 2:
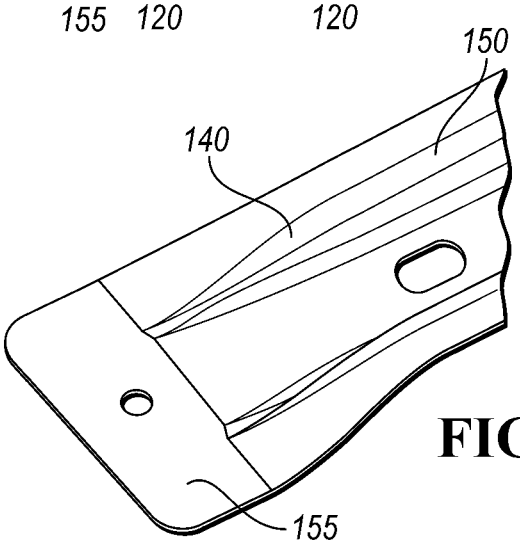
FIG. 2 shows a partial perspective view of a vehicle part with variable strength zones.

Referring to FIGS. 1A and 1B, a hot stamping die 100 for forming PHS parts is shown. According to an embodiment, die 100 includes a body 110 made of a bulk material. In some embodiments, the entire die may be made of 3D printed bulk material. In other embodiments, the die may be modular and include multiple 3D printed inserts for forming the die features. The body 110 includes a stamping surface 105, which is capable of receiving a steel blank and is configured to hot stamp the blank between the die 100 and a paired die (not shown) to form the vehicle part. The stamping surface 105 may be shaped according to the shape of the desired stamped part. Die 100 also includes conformal cooling channels 120 defined within body 110. The conformal cooling channels 120 are formed using 3D-printed die inserts, and are shaped to provide varying levels of cooling to region(s) of the stamping surface 105 (or surface region(s)). The inserts for conformal cooling channels 120 are positioned in the die for varying cooling according to U.S. Ser. No. 15/467,607, which is hereby incorporated by reference in its entirety. In addition, hot stamping die 100 includes heating element 130 defined within the body 110. According to an embodiment, heating element 130 is a heating channel configured to receive a heating fluid, such as a hot water flow zone or a dead flow zone. Heating element 130 is formed using a 3D-printed die insert, and shaped to provide heating, or reduce cooling, to body region(s) corresponding with a variable strength zone of the desired part. Hereinafter, based on where the heating element 130 is within the body, body region(s) refer to region(s) of the stamping surface 105 different from the surface region(s)). Referring to FIG. 1B, with the conformal cooling channels 120 and conformal heating element 130 within the body 110, steel blank 140 can be positioned on stamping surface 105 and hot stamped such that a hard zone 150 forms where cooling channels 120 have cooled the surface region(s) of stamping surface 105, and a soft zone 155 forms where heating element has heated or reduced cooling at the region(s) in the body, different from the region(s) of stamping surface 105. Thus, a vehicle part with tailored properties is formed, as shown in FIG. 2. Although only two zones are shown for the vehicle part for illustrative purposes, any number of zones can be formed using a number of printed inserts in the die.

Figure 3A:
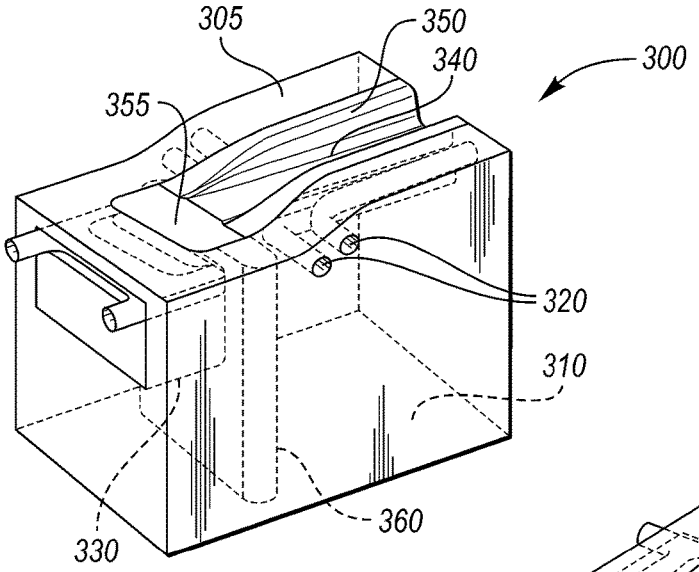
FIGS. 3A and 3B show perspective views of a schematic diagram of a hot stamping die according to another embodiment.
Figure 3B:
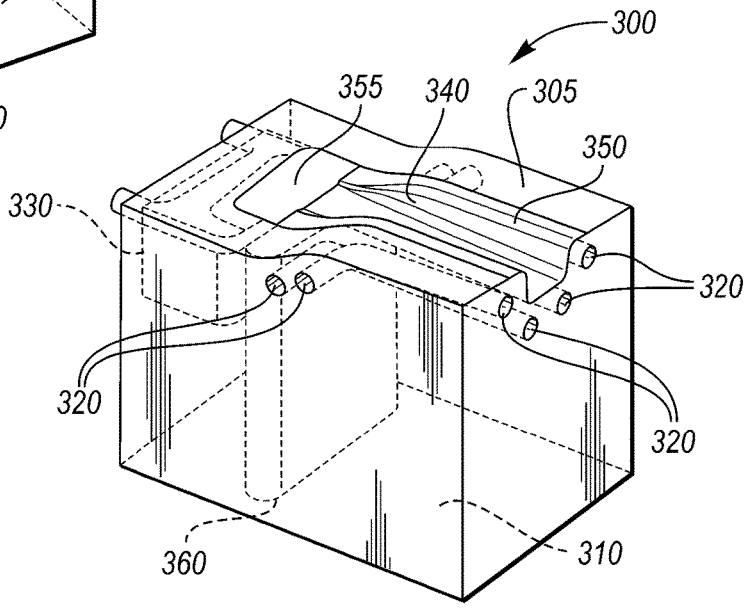
Figure 3C:
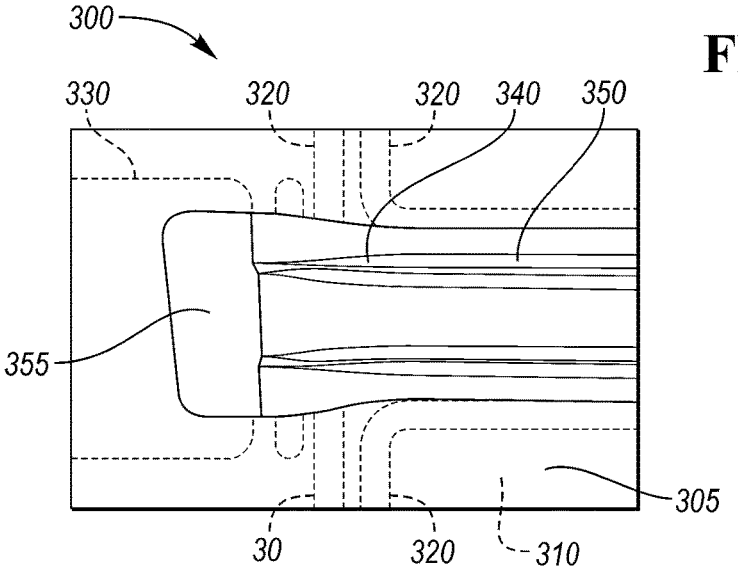
FIG. 3C shows a partial top view of the schematic diagram of the hot stamping die of FIGS. 3A-B.

Referring to FIGS. 3A, 3B, and 3C, a hot stamping die 300 for forming PHS parts is shown. According to another embodiment, die 300 includes a body 310 made of a bulk material. The body 310 includes a stamping surface 305, which is capable of receiving a steel blank and is configured to hot stamp the blank between the die 300 and a paired die (not shown) to form the vehicle part. The stamping surface 305 may be shaped according to the shape of the desired stamped part. Die 300 also includes conformal cooling channels 320 defined within body 310. The conformal cooling channels 320 are formed using 3D-printed die inserts, and are shaped to provide varying levels of cooling to region(s) of the stamping surface 305. The inserts for conformal cooling channels 320 are positioned in the die for varying cooling according to U.S. Ser. No. 15/467,607, which is hereby incorporated by reference in its entirety. In addition, hot stamping die 300 includes heating element 330 defined within the body 310. According to an embodiment, heating element 330 is a heating coil. Heating element 330 is formed using a 3D-printed die insert, and shaped to provide heat to a region(s) in the body that corresponds with different surface region(s) than the cooled region(s) of the stamping surface 305 corresponding with a variable strength zone of the desired part. Heating element 330 is separated from cooling channels 320 by an insulation barrier 360 defined within the body 310, between the heating element 330 and the cooling channels 320. Insulation barrier 360 may be an air pocket. Insulation barrier 360 is formed using a 3D-printed die insert, and is shaped to insulate the cooling channels 320 from the heating element 330.

Referring to FIG. 3C, with the conformal cooling channels 320 and conformal heating element 330 within the body 310, steel blank 340 can be positioned on stamping surface 305 and hot stamped such that a hard zone 350 forms where cooling channels 320 have cooled region(s) of stamping surface 305, and a soft zone 355 forms where heating element has heated or reduced cooling at the region(s) different from the surface region(s) (of stamping surface 305). Insulation barrier 360 allows for the heating element 330 and cooling channels 320 to efficiently heat and cool the stamping surface 305 to obtain the desired strength properties at the locations. Although only two zones are shown for the vehicle part for illustrative purposes, any number of zones can be formed using a number of printed inserts in the die. Similarly, although only one insulation barrier 360 is shown, any number of insulation barriers may be used to achieve any number of separate zones.

Figure 4A:
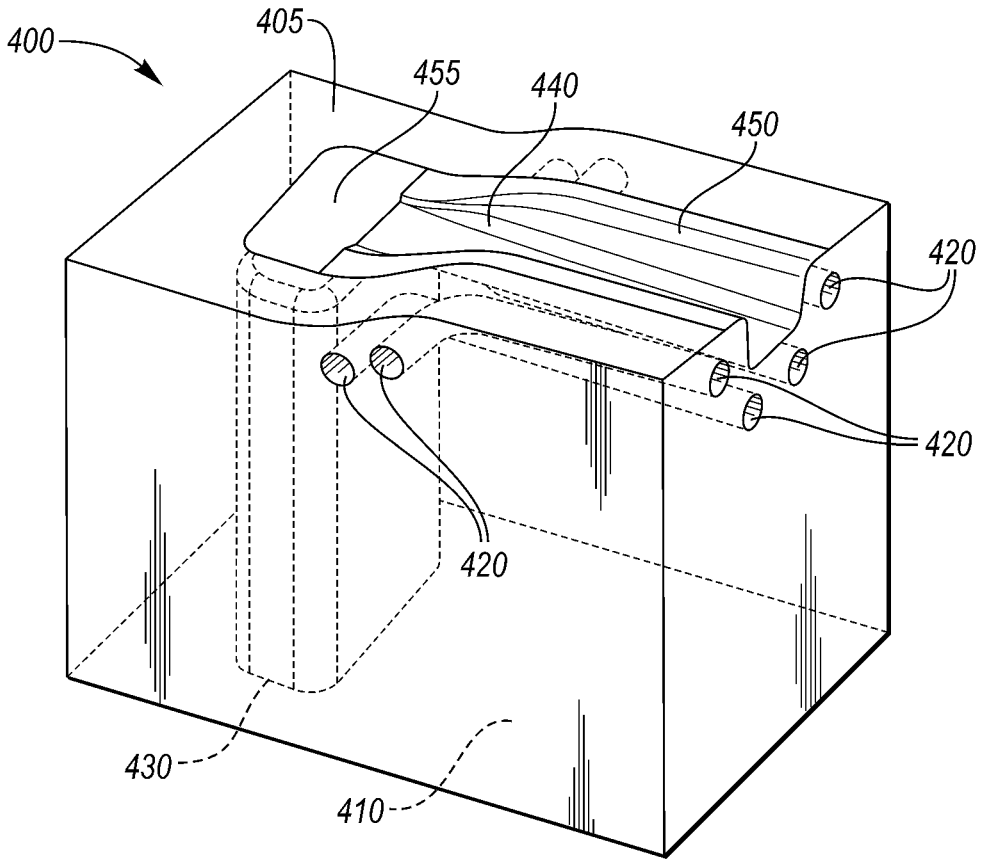
FIG. 4A shows a perspective view of a schematic diagram of a hot stamping die according to another embodiment.
Figure 4B:
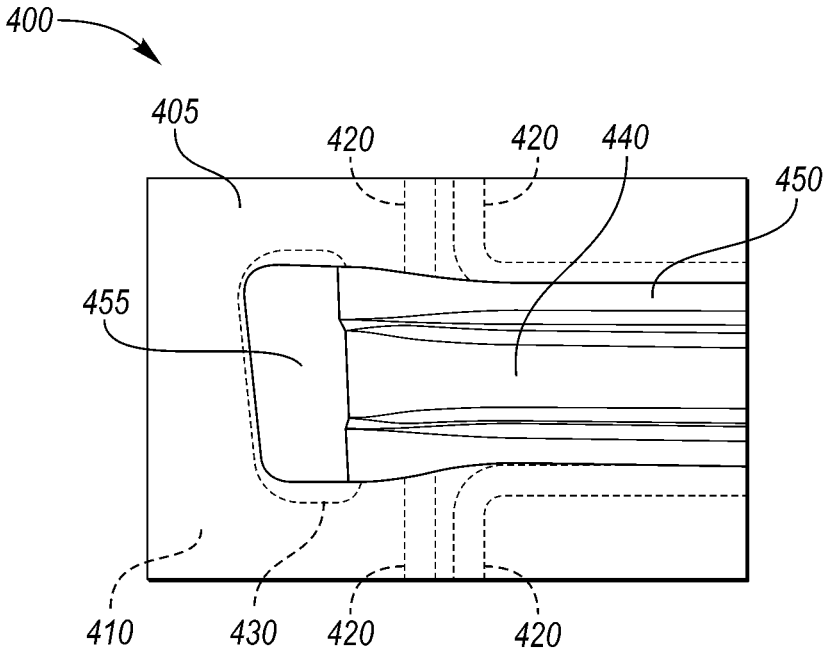
FIG. 4B shows a partial top view of the schematic diagram of the hot stamping die of FIG. 4A.

Referring to FIGS. 4A and 4B, a hot stamping die 400 for forming PHS parts is shown. According to yet another embodiment, die 400 includes a body 410 made of a bulk material. The body 410 includes a stamping surface 405, which is capable of receiving a steel blank and is configured to hot stamp the blank between the die 400 and a paired die (not shown) to form the vehicle part. The stamping surface 405 may be shaped according to the shape of the desired stamped part. Die 400 also includes conformal cooling channels 420 defined within body 410. The conformal cooling channels 420 are formed using 3D-printed die inserts, and are shaped to provide varying levels of cooling to region(s) of the stamping surface 405. The inserts for conformal cooling channels 420 are positioned in the die for varying cooling according to U.S. Ser. No. 15/467,607, which is hereby incorporated by reference in its entirety. In addition, hot stamping die 400 includes heating element 430 defined within the body 410. According to an embodiment, heating element 130 is a cavity in the body 410, directly below the stamping surface 405 where the varied PHS properties are desired. Heating element 430 is formed using a 3D-printed die insert, and is shaped to reduce cooling from the cooling channels to region(s) different from the region(s) of the stamping surface 405 corresponding with a variable strength zone of the desired part. Referring to FIG. 4B, with the conformal cooling channels 420 and conformal heating element 430 within the body 410, steel blank 440 can be positioned on stamping surface 405 and hot stamped such that a hard zone 450 forms where cooling channels 420 have cooled the region(s) of stamping surface 405, and a soft zone 455 forms where heating element has reduced cooling at the body region(s) different from the region(s) of stamping surface 405. Thus, a vehicle part with tailored properties is formed, as shown in FIG. 2. Although only two zones are shown for the vehicle part for illustrative purposes, any number of zones can be formed using a number of printed inserts in the die.

The heating element is capable of providing heat to, or reducing cooling at, the different body region(s) from the surface region(s) via the various embodiments in order to provide regions(s) on the stamping surface that can form a soft zone on the steel blank due to its elevated temperature when compared to cooled surface region(s). As such, the rate of heat transfer from the heating element to the different body region(s) (corresponding to different region(s) of the surface than the cooled surface region(s)) is greater than any heat transfer rate from the cooling channels to the surface region(s) (for example, toward an outlet of the cooling channels), in order to provide the vehicle part with tailored properties. The heat transfer rate corresponds to a cooling rate for developing soft zones such that the cooling rate required for the material (e.g., boron steel) at the different body region(s) is less than about 27 K/s, whereas the corresponding cooling rate from the surface region(s) to the channels is greater than about 27 K/s such that hard zones are formed, thus providing cooler surface region(s) than the different body region(s). The cooling rates at the surface region(s) is greater than the different body region(s) due to the heating element, such that those body region(s) of the surface have a higher temperature than the surface region(s) cooled by the channels in order to promote the formation of variable strength zones in the vehicle part. The soft zones can have different properties depending on the application. Different cooling rates will produce different mechanical properties. In addition, the heat transfer rates from the heating channel to the different body region(s), and from the surface region(s) to the cooling channels, are greater (in magnitude), than any "cross" heat transfer (i.e., from the heating element to the surface region(s), and/or from the different body region(s) to the cooling channels).

Similarly, the insulation barrier prevents heat transfer from the heating element and body region(s) to the cooling channels. The heat transfer rate from the heating element to the body region(s) is greater than the heat transfer rate from the heating element and/or the body region(s) to the cooling channels because of the insulation barrier therebetween.

According to an embodiment, a method of stamping a vehicle part is disclosed. The method includes forming a die having a stamping surface using printed inserts configured to form cooling channels and a heating element within a bulk material. The cooling channels and heating elements are configured to vary heat transfer at region(s) of the surface. Forming the die includes positioning the printed inserts in a mold and molding a body of bulk material into the hot stamping die. The method also includes positioning a blank on the surface. The method further includes stamping the blank to produce variable strength zones based on heating and cooling of the surface region(s). Cooling includes flowing or circulating a cooling fluid through the cooling channels such that heat is absorbed from select region(s) of the stamping surface. Heating includes circulating a heating fluid in the heating elements or activating a heating coil to heat select region(s) different from the cooled select region(s) of the stamping surface.

According to one or more embodiments, a hot stamping die with conformal cooling channels and a heating element is provided. The conformal cooling channels and heating element interact with the stamping surface such that heat is removed from surface region(s), and is transferred to (or cooling is reduced at) the surface at different body region(s) (corresponding to different region(s) of the stamping surface from the surface region(s)), respectively. The channels and heating element can be cast-in the die using 3D-printed inserts such that a conformal shape with high efficiency heat transfer capabilities can be achieved. In some embodiments, an insulation barrier is also included to reduce heat transfer between the region(s), and formed using conformal 3D-printed inserts as well. Thus, the stamping surface has warmer region(s) based on the heated body region(s) relative to the cooled surface region(s) such that when a blank is stamped, the resulting part has variable strength zones based on the temperature of the stamping surface in those region(s).

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A hot stamping die comprising:

a body having, along a vertical axis, a top end, a bottom end opposite the top end, and a middle portion extending vertically therebetween; the body having a stamping surface defined at the top end;

cooling channels positioned below the stamping surface along the vertical axis within the middle portion of the body to transfer heat from surface region(s) of the stamping surface to the channels a heating element within the middle portion of the body and below the cooling channels along the vertical axis, the heating element being separate and apart from the channels, and positioned below the cooling channels at specific body region(s) of the middle portion to reduce heat transfer from the surface region(s) to the cooling channels at specific surface region(s) corresponding to the specific body region(s); and an insulation barrier within the middle portion of the body and positioned between the heating element and the channels, the insulation barrier separating the heating element from the channels.

2. The hot stamping die of claim 1, wherein a heat transfer rate from the heating element to the body region(s) corresponds to a cooling rate of less than about 27 K/s.

3. The hot stamping die of claim 1, wherein a heat transfer rate from the channels to the surface region(s) corresponds to a cooling rate of greater than about 27 K/s.

4. The hot stamping die of claim 1, wherein the heating element is a heating coil.

5. The hot stamping die of claim 1, wherein the heating element is a heating channel configured to receive a heating fluid.

6. The hot stamping die of claim 1, wherein the heating element is a cavity in the body below the body region(s) configured to reduce heat transfer from the body region(s) to the cooling channels.

7. The hot stamping die of claim 1, wherein the insulation barrier is a cavity.

8. A hot stamping die comprising:

a body having a stamping surface defined at a top end along a vertical axis of the body;

cooling channels within the body and below the stamping, surface along the vertical axis, the cooling channels configured to remove heat from surface region(s) of the stamping surface;

a heating element within the body positioned below the cooling channels along the vertical axis at specific body region(s) to reduce heat transfer from the surface region(s) to the cooling channels at specific surface region(s) of the stamping surface corresponding to the specific body region(s); and an insulation barrier within the body and between the heating element and the cooling channels at other specific body region(s) different from the specific body region(s), the insulation barrier configured to minimize heat exchange between the heating element and channels at the other specific body region(s).

9. The hot stamping die of claim 8, wherein the insulation barrier is a cavity in the body.

10. The hot stamping die of claim 8, wherein the heating element is a heating coil.

11. The hot stamping die of claim 8, wherein the heating element is a heating channel configured to receive a heating fluid.

12. The hot stamping die of claim 8, wherein a heat transfer rate from the heating element to the body region(s) corresponds to a lower cooling rate than a heat transfer rate from the channels to the surface region(s).

13. The hot stamping die of claim 8, wherein a heat transfer rate from the heating element to the body region(s) corresponds to a cooling rate of less than about 27 K/s.

14. The hot stamping die of claim 8, wherein a heat transfer rate from the channels to the surface region(s) corresponds to a cooling rate of greater than about 27 K/s.

15. The hot stamping die of claim 8, wherein the heating element has a higher rate of heat transfer to the body region(s) than to the insulation barrier, and the channels have a higher rate of heat absorption than absorption from the insulation barrier.

16. A method of stamping a vehicle part comprising:

forming a die having a stamping surface defined at a top end along a vertical axis using printed inserts configured to form cooling channels below the stamping surface along the vertical axis for cooling surface region(s) of the stamping surface and to form a heating element within bulk material of the die such that the heating element is positioned below the cooling channels along the vertical axis at specific body region(s) corresponding to specific surface region(s) to vary heat transfer at the specific surface region(s) as compared to the surface region(s);

positioning a blank on the surface; and stamping the blank to produce variable strength zones based on heat transfer rates of the surface region(s) and specific surface region(s).

17. The method of claim 16, wherein the heating and cooling of the surface region(s) includes flowing cooling fluid through the cooling channels.

18. The method of claim 16, wherein the heating and cooling of the surface region(s) includes circulating heating fluid in the heating, elements or activating a heating coil.

19. The method of claim 16, wherein the forming step includes positioning the printed inserts in a mold and molding a body of bulk material into a die.

* * * * *